US009130298B1

(12) United States Patent
Baydoun

(10) Patent No.: US 9,130,298 B1
(45) Date of Patent: Sep. 8, 2015

(54) GROMMET ASSEMBLY FOR VEHICLE BODY PANEL

(71) Applicant: FORD GLOBAL TECHNOLOGIES, LLC, Dearborn, MI (US)

(72) Inventor: Mohammed Michael Baydoun, Dearborn Heights, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 23 days.

(21) Appl. No.: 14/183,576

(22) Filed: Feb. 19, 2014

(51) Int. Cl.
*H01R 13/516* (2006.01)
*H01R 13/52* (2006.01)
*H01R 13/74* (2006.01)

(52) U.S. Cl.
CPC ..... *H01R 13/516* (2013.01); *H01R 13/5202* (2013.01); *H01R 13/743* (2013.01)

(58) Field of Classification Search
CPC .. H01R 13/743; H01R 13/5202; H01R 13/74; H01R 13/745
See application file for complete search history.

(56) References Cited

U.S. PATENT DOCUMENTS 5,044,986 A * 9/1991 Baumanis ..... 439/548
5,249,982 A * 10/1993 Funck et al. ..... 439/556
5,328,388 A 7/1994 Fust et al.
5,448,017 A 9/1995 Nakajima et al.
5,621,328 A * 4/1997 Yamanashi ..... 324/538
5,626,493 A * 5/1997 Post et al. ..... 439/555
5,660,564 A * 8/1997 Yamanashi et al. ..... 439/557
6,139,346 A * 10/2000 Cecil et al. ..... 439/247
6,312,285 B1 * 11/2001 Berg et al. ..... 439/545
6,338,651 B1 * 1/2002 Svette et al. ..... 439/559
6,422,899 B1 * 7/2002 Miyazaki ..... 439/559
6,593,529 B2 7/2003 Nakata et al.
6,600,104 B2 7/2003 Nakata et al.
6,600,105 B2 7/2003 Nakata et al.
6,656,037 B2 * 12/2003 Matsushita ..... 439/544
6,779,243 B2 8/2004 Nakata
6,844,497 B2 1/2005 Frantz et al.
6,848,938 B2 * 2/2005 Miyamoto ..... 439/557
6,860,759 B2 * 3/2005 Nakamura et al. ..... 439/557
7,020,931 B1 4/2006 Burnett et al.
7,090,533 B1 * 8/2006 Houck et al. ..... 439/553
7,094,099 B2 * 8/2006 Daggett et al. ..... 439/567
7,318,748 B2 * 1/2008 Yamakado ..... 439/557
7,371,110 B2 * 5/2008 Murakami et al. ..... 439/557
7,384,303 B2 * 6/2008 Murakami et al. ..... 439/557
7,547,059 B2 6/2009 Delaine
7,615,713 B2 11/2009 Bardella et al.

(Continued)

FOREIGN PATENT DOCUMENTS

GB 2149469 A 6/1985
KR 19970024388 5/1997

*Primary Examiner* — Ross Gushi
(74) *Attorney, Agent, or Firm* — Damian Porcari; Brooks Kushman P.C.

(57) ABSTRACT

A vehicle includes a body panel defining a pass-through, a grommet sealed against the body panel, an electrical connector having a surface defining a sleeve and a tab, and a walled retainer in the grommet and seated within the pass-through. The walled retainer has a prong formed thereon. The prong is configured to slidably receive the sleeve orienting the electrical connector within the pass-through. The prong further defines a channel terminating a ledge. The channel, ledge, and tab are arranged such that the channel and ledge cooperate to retain the tab to prevent movement of the connector relative to the walled retainer.

20 Claims, 3 Drawing Sheets

(56) References Cited

U.S. PATENT DOCUMENTS

| | | | | |
|---|---|---|---|---|
| 7,659,480 | B2 | 2/2010 | Bikhleyzer | |
| 7,834,272 | B2 | 11/2010 | Bikhleyzer | |
| 7,845,989 | B2 * | 12/2010 | Hiramatsu et al. | 439/701 |
| 7,952,032 | B2 | 5/2011 | Suzuki | |
| 8,022,304 | B2 | 9/2011 | Baydoun et al. | |
| 8,419,485 | B2 * | 4/2013 | Stausser et al. | 439/752 |
| 2004/0029440 | A1 * | 2/2004 | Bigotto | 439/557 |
| 2004/0077213 | A1 * | 4/2004 | Sakiyama et al. | 439/557 |
| 2007/0190835 | A1 * | 8/2007 | Yamakado | 439/157 |
| 2014/0113471 | A1 * | 4/2014 | Shimizu et al. | 439/157 |
| 2015/0079839 | A1 * | 3/2015 | Takemura | 439/559 |

* cited by examiner

GROMMET ASSEMBLY FOR VEHICLE BODY PANEL

TECHNICAL FIELD

The present application relates to grommet assemblies for vehicle body panels.

BACKGROUND

Electrical connectors are required in order to make electrical connections throughout a vehicle. Certain connectors may need to pass through vehicle body panels. These connectors should be properly seated within the body panels.

SUMMARY

A vehicle includes a body panel defining a pass-through, a grommet covering the pass-through and sealed against the body panel, an electrical connector having a surface defining a sleeve and a tab, and a walled retainer in the grommet and seated within the pass-through. The walled retainer has a prong formed thereon configured to slidably receive the sleeve to orient the electrical connector within the pass-through. The prong defines a channel terminating at a ledge. The channel, ledge, and tab are arranged such that the channel and ledge cooperate to retain the tab to prevent movement of the connector relative to the walled retainer.

A vehicle includes a body panel defining a pass-through, a grommet covering the pass-through and sealed against the body panel, and a walled retainer in the grommet and seated within the pass-through. The walled retainer has a prong formed thereon. The prong is configured to slidably receive a sleeve of an electrical connector to orient the electrical connector within the pass-through. The prong defines a channel terminating at a ledge. The channel and ledge are configured to retain a tab of the electrical connector to prevent movement of the connector relative to the walled retainer when engaged.

A vehicle includes a body panel defining a pass-through, a grommet covering the pass-through and sealed against the body panel, and a walled retainer in the grommet and seated within the pass-through. The walled retainer has a prong formed thereon. The prong is configured to slidably receive an electrical connector and orient the electrical connector within the pass-through. The vehicle further includes an electrical connector. The electrical connector includes a sleeve engaged with the prong to connect the electrical connector to the walled retainer.

DETAILED DESCRIPTION

As those of ordinary skill in the art will understand, various features of the present invention is illustrated and described with reference to any one of the Figures may be combined with features illustrated in one or more other Figures to produce embodiments of the present disclosure that are not explicitly illustrated or described. The combinations of features illustrated provide representative embodiments for typical applications. However, various combinations and modifications of the features consistent with the teachings of the present disclosure may be desired for particular applications or implementations.

Figure 1:
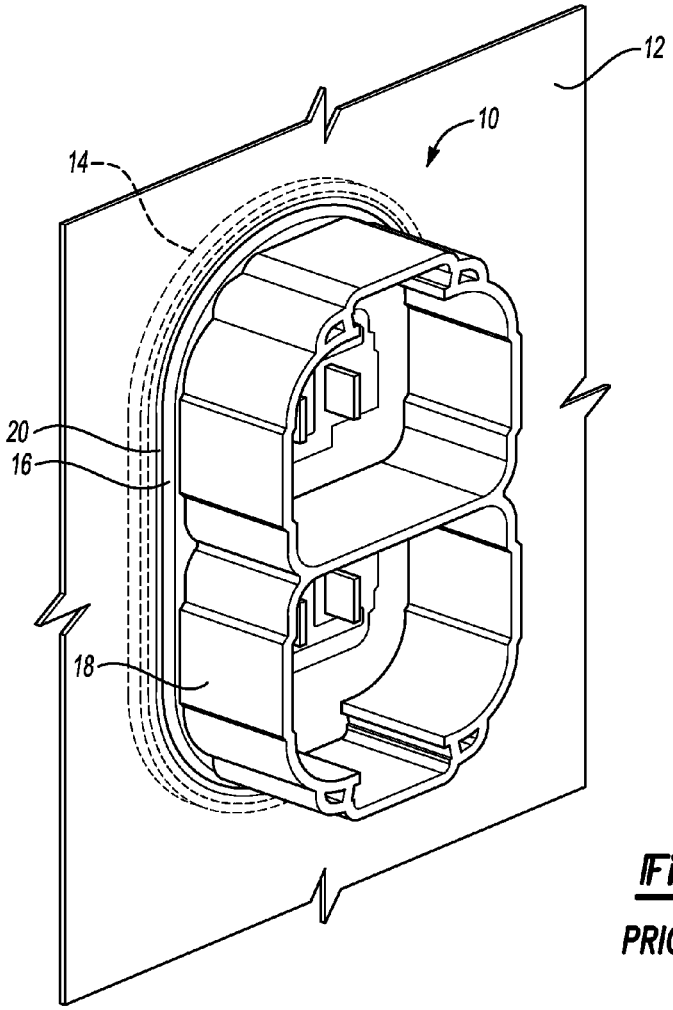
Fig-1 PRIOR ART
FIG. 1 is a perspective view showing a vehicle body panel having a pass-through, a grommet covering the pass-through, and a prior art retainer having electrical connectors formed to the retainer.

Referring to FIG. 1, a prior art grommet assembly 10 for a vehicle body panel 12 is provided. The grommet assembly 10 includes a grommet 14, a retainer 16, and at least one electrical connector 18. The retainer 16 is surrounded by the grommet 14 and is secured to a pass-through 20 in a vehicle door body panel 12. Generally, as shown in FIG. 1, the electrical connectors 18 are formed on the retainer 16. This makes the retainer 16 and electrical connectors 18 one piece. This retainer 16 and electrical connector 18 design has a set number of electrical connections. With a set number of electrical connections, the current design cannot be adapted to support differing electrical requirements. Lacking adaptability, the current design has some disadvantages. Different vehicle packages require a variety of differing electrical connections. For example, a vehicle with power locks and windows will need more electrical connections than a vehicle with manual windows and locks. It may be advantageous then to use additional electrical connectors 18 with a vehicle having more electrical options and fewer electrical connectors 18 with vehicles requiring less electrical connections.

The current retainer 16, with formed electrical connectors 18, does not allow for interchangeability between similar vehicles with differing electrical requirements. Retainer size is dependent on a thickness of the vehicle body panel 12, and the type and number of electrical connectors 18 is dependent on electrical options. Therefore, a design in which the number of electrical connections varies within a standard retainer 16 may have numerous advantages. For example, a body panel thickness between 1-3 mm would be able to use the same retainer 16 regardless of the amount of electrical connections. A larger electrical connector 18 could just be attached to the retainer 16 already in use. Likewise, vehicles requiring fewer electrical connections would be able to use a smaller electrical connector 18. This saves cost by eliminating the need for the larger electrical connector 18. Further by forming the electrical connectors 18 to the retainer 16, the grommet 14 must be modified. Modifying the grommet 14 to fit the retainer 16 causes problems sealing the grommet assembly 10 to the vehicle body panel 12. It also requires more force to insert the grommet assembly 10 into the pass-through 20 defined in the vehicle body panel 12.

It may be advantageous to design a grommet assembly 10 capable of providing a variety of different electrical connectors 18 while maintaining a standard retainer 16 size. Forming a retainer 16 capable of supporting a variety of different electrical connectors 18 allows for flexibility when similar vehicles need different electrical connections. Having flexibility with the electrical connectors 18 provides for standardization of grommet assembly 10 per vehicle body panel 12 thicknesses. For example, a vehicle package with power windows and locks might require two large electrical connectors 18. A vehicle without power windows or locks might require one large and one small electrical connector 18. Providing for a variety of electrical connectors 18 to be supported by the retainer 16 allows the grommet assembly 10 to be dependent on vehicle body panel 12 thickness. A standard grommet 14 and retainer 16 could be used to fit a range of body panel thicknesses, while being able to account for differing electrical requirements. Having interchangeable electrical options for the grommet assembly 10 eliminates concerns regarding the number of electrical connections and the vehicle body panel 12 thickness. This may save time, cost, and manufacturing expenses.

Figure 2:
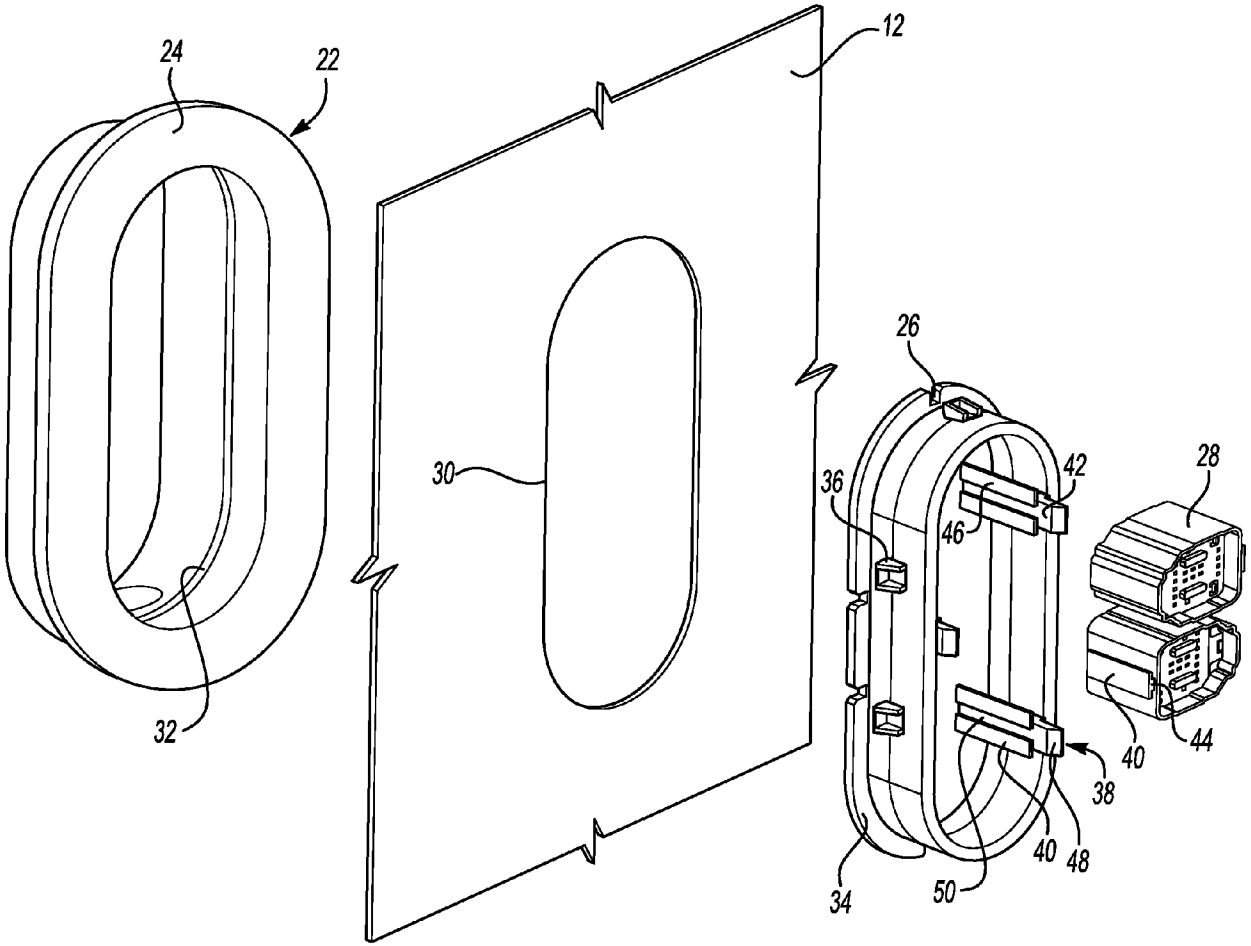
FIG. 2 is an exploded perspective view showing a vehicle body panel with the pass-through press, a grommet, a walled retainer having a prong, and an electrical connector.

Referring to FIG. 2, a grommet assembly 22 for a vehicle body panel 12 is provided. The grommet assembly 22 includes a grommet 24, a walled retainer 26, and an electrical connector 28. The grommet 24 covers a pass-through 30 defined by the body panel 12 and is sealed against the body panel 12. The grommet 24 also includes a groove 32. The walled retainer 26 has an edge portion 34 that mates with the groove 32 to secure the walled retainer 26 to the grommet 24. The walled retainer 26 is seated within the pass-through 30 defined by the body panel 12. A plurality of tabs 36 formed around the perimeter of the walled retainer 26 engages the body panel 12. Engagement between the plurality of tabs 36 and the body panel 12 seats the walled retainer 26 within the pass-through 30. The walled retainer further includes a prong 38 formed on the walled retainer 26.

The prong 38 has a hat shaped cross-sectional area and is configured to slidably receive an electrical connector 28. The electrical connector 28 includes a sleeve 40 that engages the prong 38. The electrical connector 28 may be of varying size, shape, and terminal patterns. Therefore, the prong 38 must be able to receive a variety of different electrical connectors 28 with differing sleeve 40 designs. For example, the prong 38 is capable of receiving and interchanging multiple different electrical connectors 28 using a clip slot design. The prong 38 supports the differing electrical connectors 28 and orients them within the body panel pass-through 30. Adapted to support different types of electrical connectors 28, the prong 38 allows for interchangeability between different types of electrical connectors 28.

For example, a smaller electrical connector 28 would suffice if the application did not need too many electrical connections. However, applications requiring a lot of electrical connections require a larger or multiple electrical connectors 28. The prong 38 is adapted to secure either of a small 28 or a large electrical connector 28 or any other range of electrical connectors 28. Being able to simply interchange the electrical connector 28 allows for some standardization of retainer 26 and grommet 24 sizes depending on vehicle body panel 12 thicknesses. This saves packaging space and also allows for some flexibility during manufacturing.

The prong 38 is designed with a hat-shaped cross sectional area. The sleeve 40, despite having various styles, utilizes this same design. It has a complementary cross-sectional area that secures the electrical connector 28 to the prong 38. The prong 38 has two portions. A first portion 42 has a width that allows the first portion 42 to slide through the sleeve 40. The electrical connector 28 may also include a tab 44. The tab 44 engages the first portion 42 of the prong 38 and prevents the electrical connector 40 from sliding vertically off of the prong 38. It does this using a ledge 48 and a channel 50 disposed on the first portion 42 of the prong 38 immediately below the ledge 48. As the ledge 48 of the first portion 42 of the prong 38 slides past the tab 44, the tab 44 engages the channel 50.

The second portion 46, being substantially wider than the first portion 42, engages the sleeve 40 holding the electrical connector 28 against the prong 38. This constrains the electrical connector 28 to the prong 38 in the horizontal direction. This does not permanently affix the electrical connector 28 to the retainer 26. The prong 38 is designed to allow the electrical connectors 28 to be removed and replaced by a different electrical connector 28 depending on the application. Slight lateral pressure on the first portion 42 of the prong 38 disengages the first portion 42 from the tab 44. This allows the sleeve 40 to slide off of the second portion 46 of the prong 38.

Figure 3:
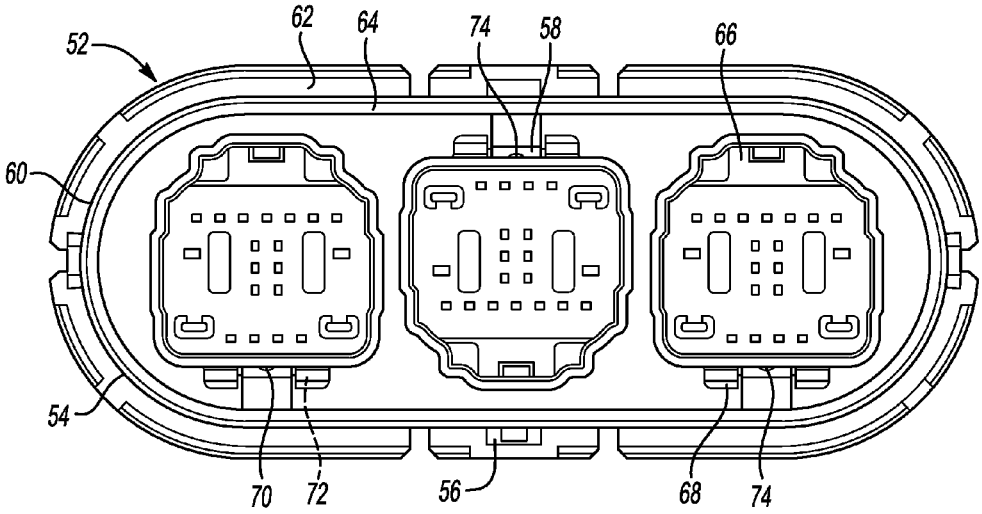
FIG. 3 is a top view of a walled retainer having a prong and an electrical connector attached to the prong.

Referring to FIG. 3, a walled retainer 52 is provided. The walled retainer 52 may include a frame 54, a plurality of tabs 56, and at least one prong 58. The frame 54 may be made of a relatively hard material. Further, the plurality of tabs 56 may be formed on an outer wall 60 of the frame 54. The plurality of tabs 56 secures the walled retainer 52 within a pass-through (not shown) in a vehicle body panel (not shown). The frame 54 may also include an edge portion 62 disposed on the outer wall 60 of the frame 54. The edge portion 62 may be used to secure the walled retainer 52 to a grommet (not shown).

At least one prong 58 is attached to an inner wall 64 of the frame 54. The prong 58 does not engage the vehicle body panel (not shown) and is within the pass-through (not shown) of the vehicle body panel. The at least one prong 58 is positioned such that it secures an electrical connector 66 within the vehicle body panel pass-through. The prong 58 does not permanently affix the electrical connector 66. Having a hat-shaped cross sectional area, the prong 58 engages a sleeve 68 on the electrical connector 66. The sleeve 68 has a complementary cross-sectional area that mates with the prong 58. The at least one prong 58 has modularity such that many different electrical connectors 66 may be used interchangeably per prong 58.

For example, a prong 58 has the capability to receive one of most different types, sizes, and terminal patterns depending on the need of the electrical connector 66. This allows for different options of electrical connectors 66 to be used with a standard retainer 52 and grommet (not shown) for each range of vehicle body panel thickness. Allowing for differing types and styles of electrical connectors 66, the prong 58 supports at least one as well as a variety of differing electrical connectors 66 within the pass-through (not shown). This modularity allows the prong 58 to support differing types and styles of electrical connectors 66.

Achieving the desired modularity is dependent on the interaction between the prong 58 and the sleeve 68 on the electrical connector 66. The prong 58 has two portions. A first portion 70 being less wide than a second portion 72. The first portion 70 is designed to direct the prong 58 through the complementary sleeve 68 on the electrical connector 66. The first portion 70 slides through the sleeve 68 until it engages a tab 74 on the electrical connector 66.

This aids in securing the electrical connector 66 to the prong 58. The tab 74 is disposed at a distance from the sleeve 68. The distance between the sleeve 68 and the tab 74 is such that as the first portion 70 of the prong 58 engages the tab 74, the second portion 72 of the prong 58 engages the sleeve 68. This constrains the electrical connector 66 both laterally and longitudinally to the prong 58. The electrical connector 66 may be released from the prong 58. Lateral pressure on the first portion 70 of the prong 58 disengages the tab 74 from the prong 58 and allows the sleeve 68 to slide off of the second portion 72 of the prong 58. Any size, type, or terminal pattern electrical connector 66 utilizing this sleeve 68 and tab 74 design may be used with the walled retainer 52.

Figure 4:
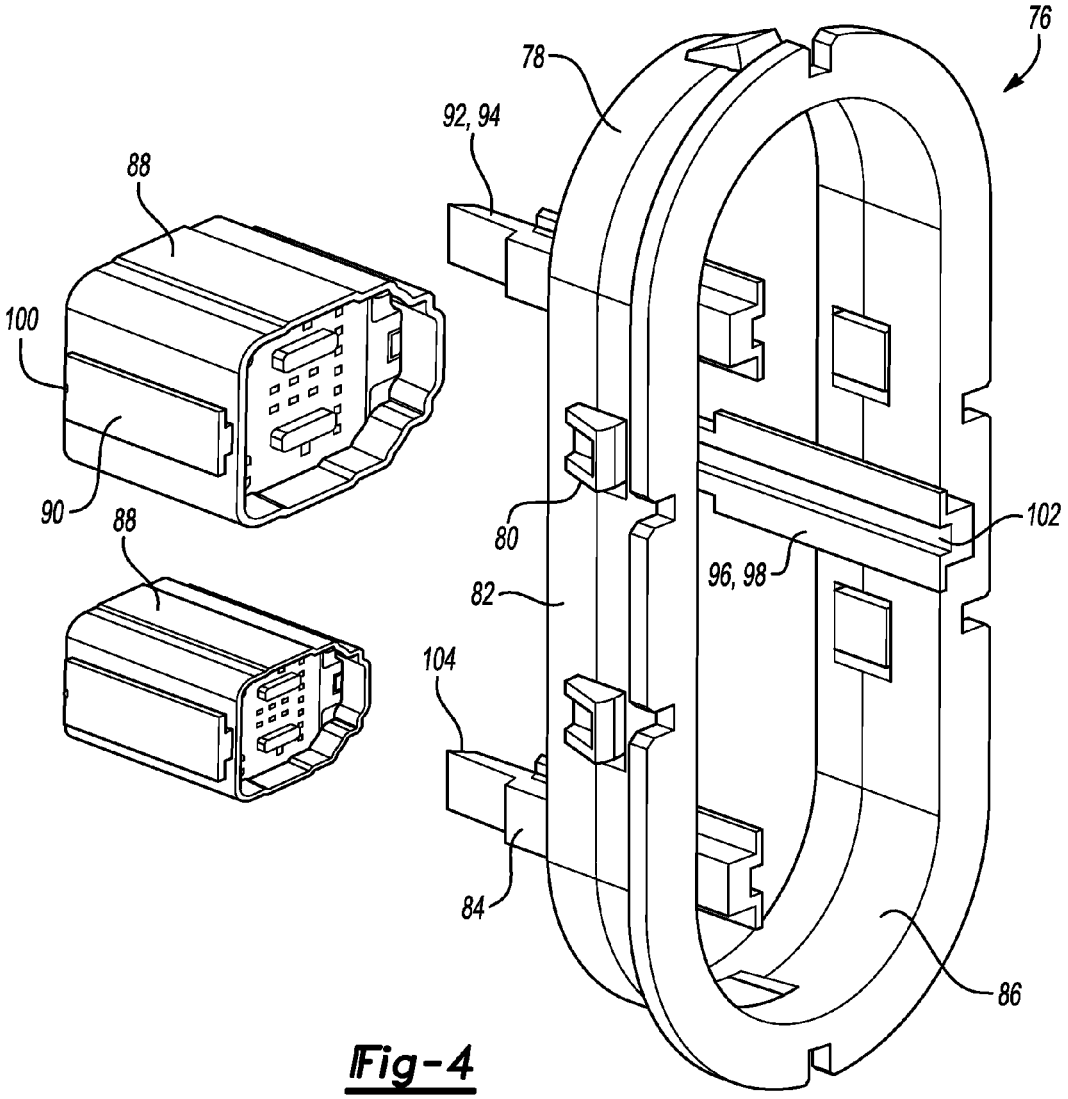
FIG. 4 is a perspective view of a walled retainer and a plurality of attached electrical connectors of different sizes.

Referring to FIG. 4, a walled retainer 76 is provided. The walled retainer 76 may include a frame 78. The frame 78 is formed with a plurality of tabs 80 on an outer wall 82 and at least one prong 84. The plurality of tabs 80 engages a vehicle body panel (not shown) and secures the walled retainer 76 within a pass-through (not shown) in a vehicle body panel. The at least one prong 84 may be formed on an inner wall 86 of the frame 78. Forming the prong 84 on the inner wall 86 positions it within the pass-through. Designs that allow interchangeability between electrical connectors 88 within a pass-through in a vehicle body panel may utilize a hat-shaped cross-sectional area that engages a complementary sleeve 90 on the electrical connectors 88. Engaging the sleeve 90 may be done in a variety of different ways. There are many different styles of sleeve 90. However, each style incorporates the complementary hat-shaped cross-section of the prong 84, such as in a clip-slot design. Utilizing this design, the prong 84 can be adapted to fit a large variety of electrical connectors 88.

For example, the walled retainer 76 may be used in an application that uses only 26 terminals on the electrical connector 88 and the prong 84 is able to support this type of electrical connector 88. Further, the same type of walled retainer 76 may be used in an application that requires use of 52 terminals on the electrical connector 88. The prong 84 would also be able to support this larger electrical connector 88 despite it being different from the smaller terminal electrical connector 88. The attachment between the prong 84 and electrical connector 88 is dependent on the cross-sectional area of the prong 84. The cross-sectional area of the prong 84 slidably receives the sleeve 90. The prong 84 has a height allowing it to extend above the inner wall 86 of the walled retainer 76. The prong 84 has a first width 92 at a first portion 94 and a second width 96 at a second portion 98.

The second width 96 and portion 98 are wider than the first width 92 and portion 94. The first portion 94 allows the prong 84 to slide through the sleeve 90. The second portion 98 engages and secures the sleeve 90 to the prong 84. As the prong 84 slides through the sleeve 90, the first portion 94 of the prong 84 interacts with a tab 100 on the sleeve 90. Designed with a channel 102 through the center, the first portion 94 of the prong 84 engages the tab 100 and prevents the electrical connector 88 from sliding off of the prong 84. The tab 100 fits into the channel 102 and is prevented from sliding off the prong 84 by a tip segment 104 of the first portion 94. The tip segment 104, which does not include the channel 102, acts as a barrier to the tab 100 and constrains the electrical connector 88. The second portion 98 of the prong 84 engages a wider section of the sleeve 90. The width of the second portion 96 is such that the engagement between the second portion 98 and the sleeve 90 prevents the electrical connector 88 from moving laterally within the walled retainer 76. This allows the prong 84 to secure the electrical connector 88 within the walled retainer 76 in both directions.

To remove the electrical connector 88 from the prong 84, lateral pressure on the first portion 94 is required. Applying lateral pressure to the first portion 94 of the prong 84 disengages the tab 100 from the channel 102. This allows the sleeve 90 to slide off of the second portion 98 of the prong 84. Being able to remove the electrical connector 88 permits the retainer 76 to constrain a variety of electrical connectors 88. Traditionally, retainers 76 have only been able to support one type or another, and have not been able to support the use of different types simultaneously. The prong 84 has this modularity and allows for interchangeability between different styles, sizes, and capabilities.

While the best mode has been described in detail, those familiar with the art will recognize various alternative designs and embodiments within the scope of the following claims. While various embodiments may have been described as providing advantages or being preferred over other embodiments with respect to one or more desired characteristics, as one skilled in the art is aware, one or more characteristics may be compromised to achieve desired system attributes, which depend on the specific application and implementation. These attributes include, but are not limited to: cost, strength, durability, life cycle cost, marketability, appearance, packaging, size, serviceability, weight, manufacturability, ease of assembly, etc. The embodiments discussed herein that are described as less desirable than other embodiments are prior art implementations with respect to one or more characteristics are not outside the scope of the disclosure and may be desirable for particular applications.

What is claimed is:

1. A vehicle comprising:

a body panel defining a pass-through;

a grommet covering the pass-through and sealed against the body panel;

an electrical connector having a surface defining a sleeve and a tab; and a walled retainer in the grommet, seated within the pass-through, and having a prong formed thereon being configured to slidably receive the sleeve to orient the electrical connector within the pass-through, wherein the prong defines a channel therealong terminating at a ledge and wherein the channel, ledge and tab are arranged such that the channel and ledge cooperate to retain the tab to prevent movement of the connector relative to the walled retainer.

2. The vehicle of claim 1 wherein the prong is hat-shaped in cross-section.

3. The vehicle of claim 1 wherein the prong includes a wedge-shaped end portion.

4. The vehicle of claim 1 wherein the walled retainer further has a plurality of tabs formed around a perimeter thereof and configured to engage the body panel.

5. The vehicle of claim 1 wherein the walled retainer defines a wall and wherein a height of the prong is greater than a height of the wall.

6. The vehicle of claim 1 wherein the grommet includes a groove and wherein the walled retainer further has an edge portion retained by the groove.

7. A vehicle comprising:

a body panel defining a pass-through;

a grommet covering the pass-through and sealed against the body panel; and a walled retainer in the grommet, seated within the pass-through, and having a prong formed thereon being configured to slidably receive a sleeve of an electrical connector to orient the electrical connector within the pass-through, wherein the prong defines a channel therealong terminating at a ledge and wherein the channel and ledge are configured to retain a tab of the electrical connector to prevent movement of the connector relative to the walled retainer when engaged.

8. The vehicle of claim 7 wherein the prong is hat-shaped in cross-section.

9. The vehicle of claim 7 wherein the prong includes a wedge-shaped end portion.

10. The vehicle of claim 7 wherein the walled retainer further has a plurality of tabs formed around a perimeter thereof and configured to engage the body panel.

11. The vehicle of claim 7 wherein the walled retainer defines a wall and wherein a height of the prong is greater than a height of the wall.

12. The vehicle of claim 7 wherein the grommet includes a groove and wherein the walled retainer further has an edge portion retained by the groove.

13. A vehicle comprising:

a body panel defining a pass-through;

a grommet covering the pass-through and sealed against the body panel;

a walled retainer in the grommet, seated within the pass-through, and having a prong formed thereon configured to slidably receive an electrical connector and orient the electrical connector within the pass-through; and an electrical connector including a sleeve engaged with the prong to connect the electrical connector to the walled retainer.

14. The vehicle of claim 13 wherein the connector includes a tab and wherein the prong includes an end portion defining a ledge configured to engage the tab to prevent the connector from moving relative to the tab.

15. The vehicle of claim 14 wherein the prong further defines a channel configured to receive the tab.

16. The vehicle of claim 13 wherein the prong is hat-shaped in cross-section.

17. The vehicle of claim 13 wherein the prong includes a wedge-shaped end portion.

18. The vehicle of claim 13 wherein the walled retainer further has a plurality of tabs formed around a perimeter thereof and configured to engage the body panel.

19. The vehicle of claim 13 wherein the walled retainer defines a wall and wherein a height of the prong is greater than a height of the wall.

20. The vehicle of claim 13 wherein the grommet includes a groove and wherein the walled retainer further has an edge portion retained by the groove.

* * * * *